US008826714B2

(12) United States Patent
Bauer et al.

(10) Patent No.: US 8,826,714 B2
(45) Date of Patent: Sep. 9, 2014

(54) METHOD FOR MANUFACTURING A WALL CONNECTOR

(75) Inventors: Walter Bauer, Simmozheim (DE); Manfred Konig, Attendorn (DE)

(73) Assignee: FFG Werke GmbH, Göppingen (DE)

( * ) Notice: Subject to any disclaimer, the term of this patent is extended or adjusted under 35 U.S.C. 154(b) by 963 days.

(21) Appl. No.: 12/925,091

(22) Filed: Oct. 13, 2010

(65) Prior Publication Data

US 2011/0089682 A1 Apr. 21, 2011

(30) Foreign Application Priority Data

Oct. 16, 2009 (DE) ..... 10 2009 044 279

(51) Int. Cl.
*B21D 41/00* (2006.01)
*B21D 41/02* (2006.01)
*B21D 41/04* (2006.01)

(52) U.S. Cl.
CPC ..... *B21D 41/021* (2013.01)
USPC ..... 72/370.12; 72/370.1; 72/370.02

(58) Field of Classification Search
CPC ..... B21B 23/00; B21B 45/00; B21C 37/202; B21C 37/20; B21C 5/00; B21C 5/003; B21C 37/15; B21C 37/28; B21C 37/06; B21C 37/30; B21D 51/2615; B21D 51/2638; B21D 41/04; B21D 41/02; B21D 41/045; B21J 5/08; B61B 10/0045; B21K 21/12; B21K 1/063; B21K 1/12; A61M 5/329; D21C 37/16
USPC ..... 72/370.01, 370.02, 370.04, 370.1, 72/370.12, 370.13, 370.14, 370.15, 67, 80, 72/112, 111, 370.24, 370.25
See application file for complete search history.

(56) References Cited

U.S. PATENT DOCUMENTS

| | | | | | |
|---|---|---|---|---|---|
| 2,408,596 | A * | 10/1946 | Bednar et al. | ..... | 72/69 |
| 2,421,629 | A * | 6/1947 | Langos | ..... | 72/356 |
| 3,470,720 | A * | 10/1969 | Campbell et al. | ..... | 72/69 |
| 4,751,836 | A * | 6/1988 | Breese | ..... | 72/62 |
| 4,854,149 | A * | 8/1989 | Porucznik et al. | ..... | 72/352 |
| 4,936,503 | A * | 6/1990 | Hinds et al. | ..... | 228/173.4 |
| 6,247,346 | B1 * | 6/2001 | Dickson, Jr. | ..... | 72/370.13 |
| 7,971,463 | B2 * | 7/2011 | Forrest et al. | ..... | 72/67 |

* cited by examiner

*Primary Examiner* — Shelley Self
*Assistant Examiner* — Lawrence Averick
(74) *Attorney, Agent, or Firm* — R. S. Lombard; K. Bach

(57) ABSTRACT

The method for the manufacture of wall connector pieces is based on a thin-walled tubular blank which is first reduced in diameter at least one, preferably both ends in order to increase the wall thickness. In this way, a basis is provided for further shaping, for example, the manufacture of a connector piece (4) or a closed end (5).

6 Claims, 2 Drawing Sheets

METHOD FOR MANUFACTURING A WALL CONNECTOR

CROSS-REFERENCE TO RELATED APPLICATION

This application claims the priority benefits of German Application No. 10 2009 044 279.0 filed Oct. 16, 2009

BACKGROUND OF THE INVENTION

The invention resides in a method for the manufacture of a wall connector piece and to a wall connector piece manufactured by such a method.

For the manufacture of press fittings various methods are used including deformation by axial compression expanding, and rolling of tubular blank, EP 0 649 689 B1,for example, discloses a method for the manufacture of press fittings of copper. The tubular blanks are contained herein in a die. The end of the tube is expanded by a plunger introduced into the end of the tube. In addition, the end of the tube is axially compressed in order to increase the wall thickness thereof at least in the area of an annular bulge to be formed subsequently. In a next working step, the annular bulge is rolled from the inside of the tube in order to reduce the wall thickness again in this area and to form a desired seal seat for an O-ring.

Different from press fittings, however, wall connector pieces do not need an expanded end, but an intermediate section with a diameter which is larger than the end diameter. For the manufacture of such wall connector pieces a material with a wall thickness as small as possible should be used. A wall thickness reduction of a few tenths of a millimeter result in the manufacture of such wall connector pieces in large series in substantial savings of material.

It is therefore the object of the present invention to provide a method for a simple and economical manufacture of wall connector pieces.

SUMMARY OF THE INVENTION

The method for the manufacture of wall connector pieces is based on a thin-walled tubular blank which is first reduced in diameter at at least one, preferably both ends in order to increase the wall thickness. In this way, a basis is provided for further shaping, for example, the manufacture of a connector piece (4) or a closed end (5).

The method according to the invention for the manufacture of wall connector pieces is based on a tubular blank. The tubular blank is, in a first step, axially compressed at least at one end thereof radially inwardly so that the diameter of the end area is reduced. As a result of the diameter reductions the wall thickness is increased in connection with the use of a suitable material such as copper or copper alloys. In this way, the wall thickness of the base material can be smaller than is actually necessary in order to form a connecting structure as desired at the end of the tube. With the diameter reduction the wall thickness then however will have the desired value.

The diameter reduction is followed by another working step for the manufacture of a desired outer contour. This may be a corrugation or knurl which extends over a certain axial section of the area of reduced thickness of the tubes. The deformation step may alternatively also form for example an almost semispherical tube end. The preceding increase of the thickness of the wall may facilitate the closing of the end of the tube in the subsequent deformation step. Again, it is advantageous if a material for the wall connector piece copper or a copper alloy has been selected.

The diameter reduction to be achieved in the first deformation step may be limited to a conical area of the end of the tube which can then, in a further deformation step, be formed for example, into a semi-spherical end. Alternatively the diameter-reduced area has a certain axial length in which it is about cylindrical. The external profiling can then be achieved in an additional deformation step as desired. For this purpose, the end of the tube is placed for example into a die with a correspondingly profiled opening. Preferably this die is longitudinally separated. A plunger being driven into the reduced diameter end of the tube then expands against the end of the tube to such an extent that the material of the end of the tube is forced to assume this inner profile of the die opening.

In a preferred embodiment, the expansion is performed by two oppositely acting plungers of which one can be introduced into the tube end through the blank toward the end and the other from the outside into the open end of the tube until the two plungers come into contact with each other. Preferably then another movement stroke is performed during which the two abutting plungers are axially displaced so that the front ends of the plungers exit the end area. In this way, the formation of steps or shoulders at the inner circumference of the reduced diameter and then again somewhat expanded end area of the wall connector is avoided.

The manufacturing steps described above are used for example for the manufacture of a hose connecting area on a wall connector piece. After the manufacture of the wall connection area the blank, further manufacturing steps can be performed such as bending the tube and/or closing the other end of the wall connector piece.

For closing an end of the wall connector piece, the connector piece is for example conically axially compressed in order to increase the wall thickness, particularly at the free end thereof. In addition the diameter is reduced there to such an extent that the subsequent closing of the tube end can be performed relatively fast that is within a few seconds in a frictional procedure. The friction process for the friction welding, and consequently, the closing of the opening, which is already narrowed down to a small opening, follow.

For closing the end of the tube the rotating blank is brought at its end, which is to be closed, into contact with a friction body. Preferably, this is a rotationally symmetrical body which is also rotating, for example, in the form of a cylindrical or truncated cone-shaped or rounded edge. The friction body preferably rotates about an axis of rotation which is parallel to the axis of rotation of the blank. Preferably the distance between the two axes of rotation is changed during the friction process, for example, it is reduced. The rotational speeds of the blank and that of the friction body are preferably turned to one another in such a way that sliding friction occurs between the end of the tube and friction body. The speeds are consequently so selected that they differ from the transmission ratio as given by the diameter ratio of the blank and friction body.

A wall connector piece manufactured in this way has a small wall thickness and, consequently, the low weight and a small material consumption. On the other hand such a wall connector piece has for example a solid hose connection area to which polyethylene, i.e., PE, hose conduits or similar hose-like tubes used in water installations can be connected.

The wall connector piece may also be provided with a closed, for example semi-spherical end, which after installation provides for the possibility to conduct, that is, hold pressurized water. The closed tube end remains tight and does not permit water to escape. However, if a water supply location is to be installed the closed end of the tube can be served by an appropriate cutting device for example, a metal saw or another metal cutter can be provided with a faucet or another connection.

BRIEF DESCRIPTION OF THE DRAWINGS

The drawings exemplary of the invention show a wall connector piece and several stages in the manufacture of the wall connector piece in which.

DETAILED DESCRIPTION OF VARIOUS EMBODIMENTS

Figure 1:
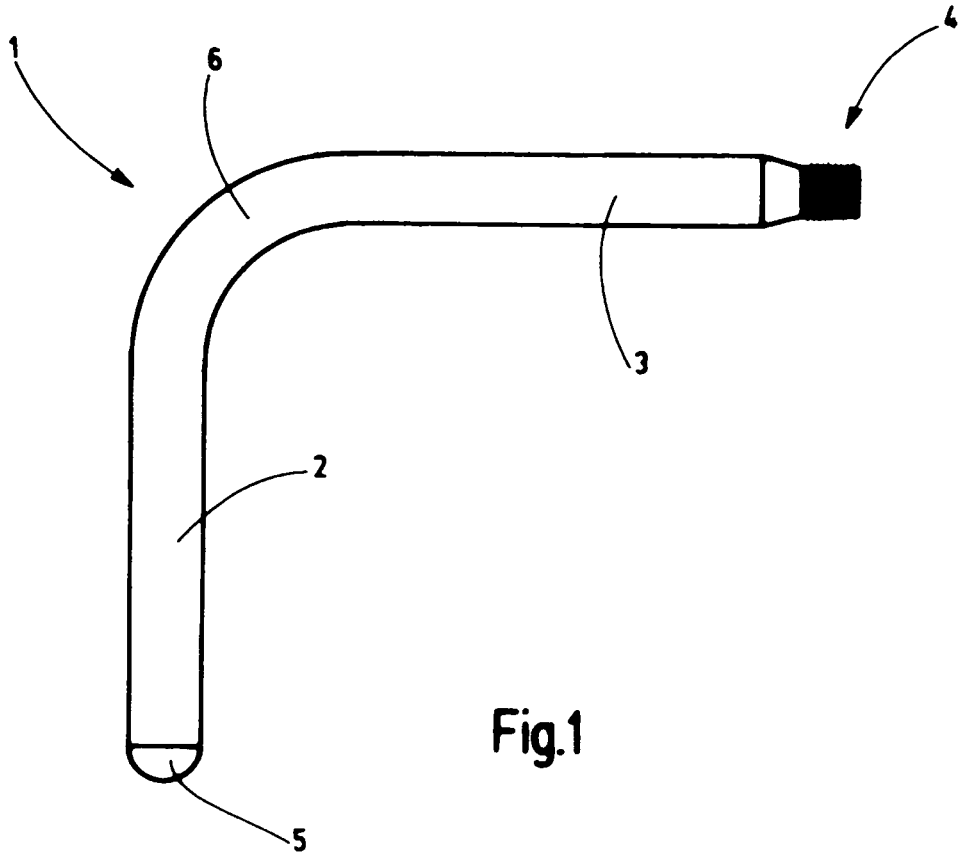
FIG. 1 shows a wall connector piece in a schematic side view.

FIG. 1 shows a wall connector piece 1 as it may be found in domestic water installations. It is formed for example by a rectangular angled tube, which has two legs or sections 2, 3. The leg 3 is for example connected to a hose or tube disposed in a wall. The leg 2 projects for example from the wall. The leg 3 may be provided at its end with a connecting area 4 for the connection of a water carrying PE-tube, a PE hose or another hose or tube. At the other leg 2 preferably a closed end 5 is formed. This closed end 5 seals the waterline off to the ambient. When a water release location is to be installed at that point the closed end can be cut off or drilled open and another water line or a faucet or similar can be installed.

The wall connector piece 1 consists of a relatively thin-walled tube, for example, a copper tube. In particular, the wall thickness of the legs 2, 3 and of the bend part 6 disposed between the legs 2, 3 is less than the connecting area 4 or the area at the closed end 5.

Figure 2:
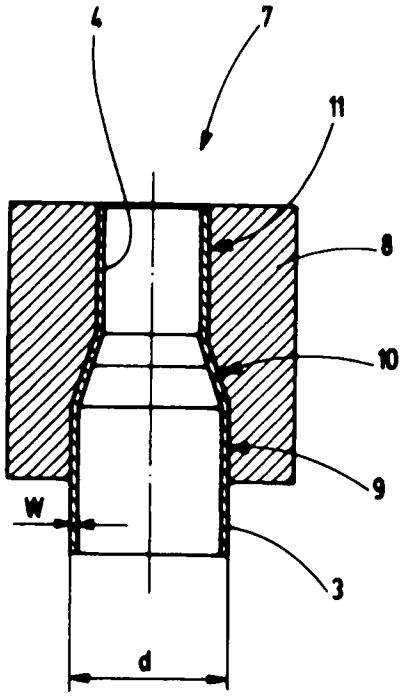
FIG. 2 shows a first working step in forming an end of the wall connection piece.

For the manufacture of the wall connector piece 1, a piece of a thin-walled tube, for example a copper tube or another metal tube is used whose end 7 is first bent radially inwardly as shown in FIG. 2. To this end, a deformation-tool 8 is used. This may consist of a single piece and have an axial bore. The bore is divided into a first, relatively wide cylindrical section 9, whose inner diameter corresponds to the outer diameter of the leg 3, a second, for example frustoconical section 10 next to the first section 9 and a third section 11 which is again cylindrical and smoothly adjoins the section 10. The diameter of the third section 11 is noticeably smaller than the diameter of the first section 9.

Figure 3:
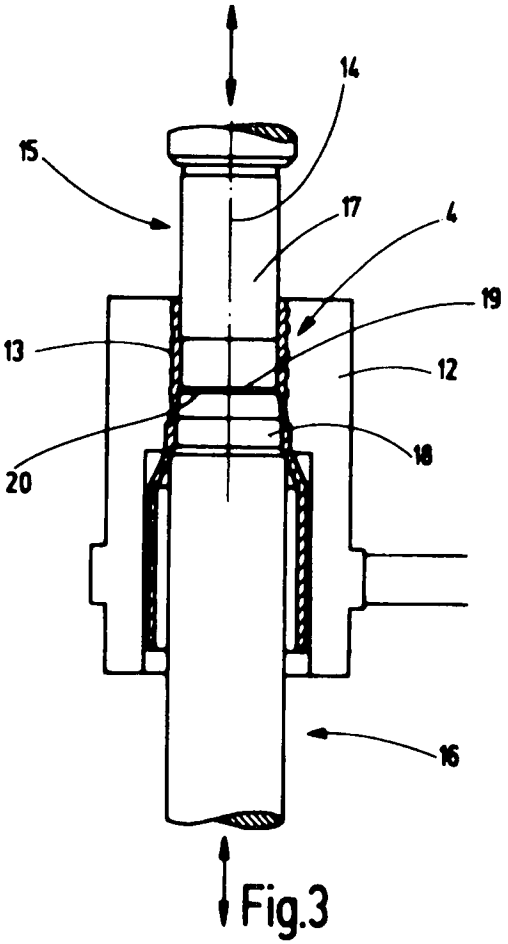

The deformation tool 8 may also be longitudinally divided into two or more parts wherein the individual parts are then radially movable and provided with a drive for moving them inwardly in order to compress the tube end 7. By the reduction of the diameter D from the diameter of the section 9 to the smaller diameter of the section 11 in the connecting area 4, the wall thickness W of the connecting area 4 is increased. When this has been achieved the blank is subjected to further working as it is shown in FIG. 3. The end 7 of the blank or respectively, of the leg 3 is now again disposed in a deforming tool 12 which, in the connecting area 4 is provided with an internally profiled bore 13. The shaping tool 12 is preferably divided longitudinally once or more times. The respective separation surfaces extend preferably parallel to a center axis 14 of the hose 13.

For further shaping, two plungers 15, 16 are now used. They act on the inside of the connecting area 4 to displace it radially outwardly. The two plungers 15, 16 are moved in opposite directions: The plunger 15 is moved through the opening of the connecting area 4 inwardly into the bore. The plunger 16 is introduced from the opposite end through the length at this time, preferably still straight blank. Both plungers 15, 16 are connected to a drive structure such as, for example, hydraulic cylinders or similar. They include each an essentially cylindrical surface area 17, 18 which is slightly conically narrowing down in the vicinity of their front faces 19, 20 and, for this purpose, bias corresponding truncated cone sections 21, 22.

The diameter of the cylindrical surface areas 17, 18 may be the same or different. In the preferred embodiment the diameter of the surface area 18 is slightly greater than the diameter of the surface area 17. Correspondingly, the cone formed by the truncated cone section 22 is somewhat steeper than that of the truncated cone section 21. In addition, the truncated cone section 22 may be axially shorter than the truncated cone section 21.

For performing the deformation procedure assigned to the plungers 15, 16, the plungers 15, 16 are moved toward each other into this connecting area 4 from opposite ends as it is shown in FIG. 3. The two front surface areas 19, 20 met within the connecting area 4. By the introduction of the plungers 15, 16 into the connecting area 4, this area is radically expanded: The area material present is now pressed into the profile structure of the bore 13 of the shaping tool 12. The operation of the plungers 15, 16 in opposite direction prevents that a material bead is pushed through the connecting area 4.

When the two plungers 15, 16 abut each other at their front faces, they are displaced jointly in axial direction while their front face contact is maintained. Until the front faces are moved out of the connecting area 4 into the leg 3. In this way, a smooth, stepless and shoulderless cylindrical wall surface is obtained at the inner circumferential surface area of the connecting area 4.

Figure 4:
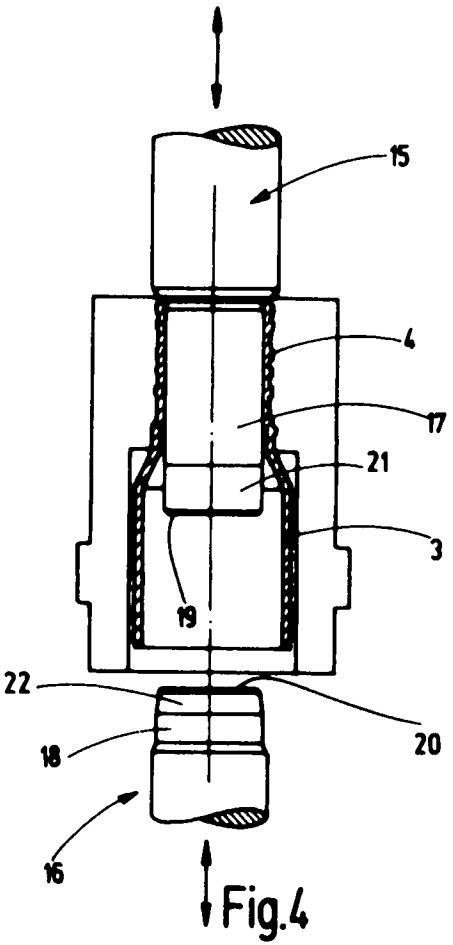
FIGS. 3 and 4 show a further working step for forming the end of the wall connector piece occurring in several partial steps.

As shown in FIG. 4, the connecting area 4 is thereby provided over its full axial length with a cylindrical surface area 17.

After the state as shown in FIG. 4 has been reached, the plungers 15, 16 are removed from the leg 3 and the wall connector piece 1 with completed connecting area 4 can be removed. On the outside, it has the profile as given by the shape of the bore 13. As shown in FIG. 1, this may be ribs which additionally are provided with knurls.

Figure 5:
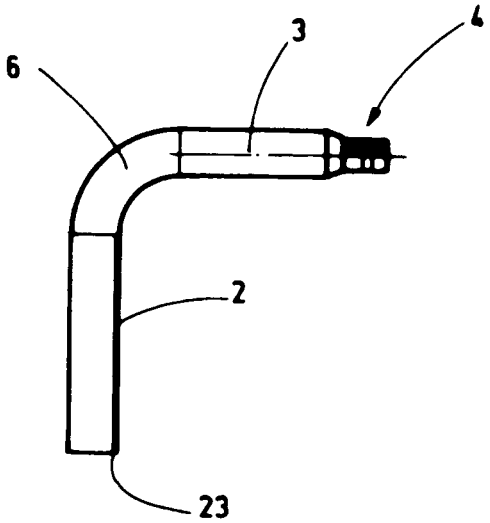
FIG. 5 shows the blank during the manufacture after bending in a schematic side view; and, FIG. 6 shows schematically a deformation step for the manufacture of an end closure of a wall connector piece by friction rolling.
Figure 6:
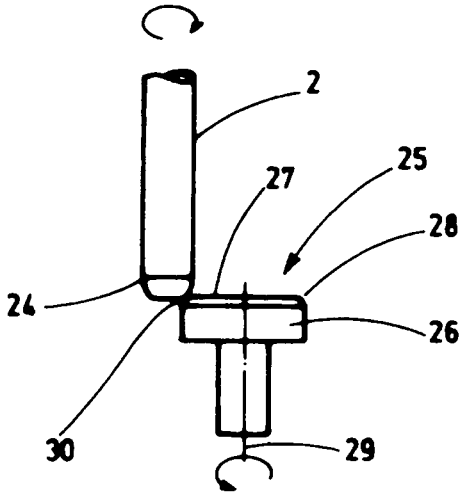

As shown, the working of a connecting area 4 comprises first a diameter reduction and an increase of the wall thickness and then a shaping that is an outside profiling of the connecting area 5. The manufacture of the closed end 5 also comprises two working steps, of which the first involves a diameter reduction and an increase of the wall thickness and the second involves further shaping. The procedure is shown in FIGS. 5 and 6. First, the still straight blank, on which the connecting area 4 has already been formed, is as shown in FIG. 5, bent over so that an elbow 6 is formed. The leg 2 is still open at its end. At the latest now, the outer end of the leg 2 is compressed to a truncated cone shape. The outer edge 23 of the leg 2 is moved radially inwardly in the process. However, a small opening remains. The truncated cone area has an increased wall area, especially at the edge 23. As shown in FIG. 6, a deformation step follows now. Herein the first formed truncated cone-shaped or otherwise reduced diameter end area 24 is closed. To this end, the leg 2 is engaged in a fixture and is rotated about its center axis. A rotational drive determines the direction and the rotational speed. For closing the end, a friction tool 25 is utilized. This has preferably rotationally symmetrical shape. It may include a cylindrical or a disc-like head 26 which has a planar top surface 27. The transition from a cylindrical outer surface to the planar top surface 27 can be formed by a conical or a curved annular surface 28. The friction tool 25 is preferably rotated about an axis of rotation 29 which extends parallel to the axis of rotation of the leg 2. A drive device determines the direction of rotation and the rotational speed of the friction tool 25. Preferably, the friction tool 25 and the leg 2 rotate in opposite direction. The rotational speeds are herein so determined that at the contact point 30 of leg 2 and the annular surface 28 or, respectively the planar top surface 27 different circumferential speeds are present so that sliding friction is established between the friction tool 25 and the respective location of the end area 24. A mixed friction/rolling procedure is established thereby during which the remaining opening at the end of the end area 24 is increasingly narrowed down and at the end closed by a friction welding process. To this end, the distance between the axis of rotation of the leg 2 and the axis of rotation 29 is continually adjusted for example by means of a corresponding control arrangement. An almost semi-spherical close end 5 is formed.

The method for the manufacture of wall connector pieces is based on the use of a thin-walled tubular blank, which is first provided with a reduced diameter area at least at one, but preferably at both ends in order to increase the wall thickness. In this way the base conditions for further shaping, for example, for the manufacture of a connecting area 4 or of a closed end 5 are established.

REFERENCE NUMERALS:

1 wall connector piece
2, 3 leg
4 connecting area
5 closed end
6 elbow
7 end
8 deformation tool
9, 10, 11 sections
12 shaping tool
13 bore
14 center axis
15, 16 plunger
17, 18 cylindrical surface area
19, 20 front face
21, 22 truncated cone section
23 edge
24 end area
25 friction tool
26 head
27 planar top surface
28 annular surface
29 axis of rotation
30 contact part

What is claimed is:

1. Method for the manufacture of a wall connector piece (1) comprising the following steps:

providing a first tube section (2) and a second tube section (3) having a predetermined uniform outer diameter (d) and a wall thickness (w);

reducing in a first deformation step the outer diameter (d) at one end (7) of the second tube section (3) to form a section of reduced-diameter while increasing the wall thickness (w) in the section of reduced-diameter; deforming in a second deformation step at the one end (7) of the section of reduced-diameter of the second tube section (3) to a desired final shape including deforming an outer profile of the section of reduced-diameter of the second tube section (3) to provide for a hose connecting area (4) by introducing the section of reduced-diameter of the second tube section (3) into a bore (13) of a shaping tool (12) provided with an internal profile, moving axially into and within the reduced-diameter section of the second tube section (3) a first plunger (15) which has an outer diameter that exceeds an inner diameter of the reduced-diameter section of the second tube section (3) to achieve the outer profile for the hose connecting area (4) by radially expanding the reduced-diameter section of the second tube section (3) from the inside thereof, moving into and within the reduced-diameter section of the second tube section (3) a second plunger (16) in opposition to the first plunger (15), the first plunger (15) having a first front face (19) and the second plunger (16) having a second front face (20), both the first plunger (15) and the second plunger (16) coming in contact with each other within the reduced-diameter section of the second tube section (3), with the first front face (19) coming in contact with the second front face (20), the first front face (19) and the second front face (20) are then moved together out of the reduced-diameter section of the second tube section (3) while the first front face (19) and second front face (20) remain in contact; and, deforming in a third deformation step at an end (5) of the first tube section (2) by rotating the first tube section (2) about a first axis of rotation and bringing the end (5) of the first tube section (2) into contact with a friction element (25) which comprises a rotatable body (26), the rotatable body (26) is driven for rotation about a second axis of rotation which is different from the first axis of rotation and the rotatable body (26) is driven without penetrating the first tube section (2) to form an end closure of the end (5) of the first tube section (2).

2. The method according to claim 1, further including during the third deformation step the first and the second axis of rotation extend parallel to each other.

3. The method according to claim 1, further including during the third deformation step both the first tube section (2) and the rotatable body (26) are moved relative to each other during the third deformation step.

4. The method according to claim 3, further including during the third deformation step the relative movement between first tube section (2) and the rotatable body (26) occurs exclusively in a radial direction.

5. The method according to claim 1, further including during the third deformation step the first tube section (2) and the rotatable body (26) are rotated in opposite rotational directions.

6. The method according to claim 1, further including during the third deformation step the rotatable body (26) of the friction element (25) has a planar front surface (27) extending at a right angle with respect to the second axis of rotation.

* * * * *